United States Patent [19]

McCarthy

[11] 4,318,487

[45] Mar. 9, 1982

[54] ADJUSTABLE END BRACKET

[75] Inventor: Dennis J. McCarthy, Springfield, Ohio

[73] Assignee: D & H Manufacturers, Inc., Springfield, Ohio

[21] Appl. No.: 119,616

[22] Filed: Feb. 8, 1980

[51] Int. Cl.[3] ..... A47F 5/01

[52] U.S. Cl. ..... 211/134; 108/42; 248/249

[58] Field of Search ..... 211/134, 90 (U.S. only), 211/153; 248/249, 250, 220.2, 222.4, 217.3; 108/42

[56] References Cited

U.S. PATENT DOCUMENTS

| | | | |
|---|---|---|---|
| 2,261,078 | 10/1941 | Shockey | 211/90 |
| 3,355,134 | 11/1967 | Chesley | 211/134 X |
| 3,432,134 | 3/1969 | Forschmidt | 211/90 X |
| 3,598,064 | 8/1971 | Stempel | 108/42 |
| 3,637,085 | 1/1972 | Ball | 211/153 |
| 3,648,626 | 3/1972 | Schuster | 211/90 X |
| 3,765,634 | 10/1973 | Stempel | 403/384 X |

FOREIGN PATENT DOCUMENTS

| | | | |
|---|---|---|---|
| 104902 | 7/1966 | Denmark | 211/153 |

*Primary Examiner*—Thomas F. Callaghan

*Attorney, Agent, or Firm*—Biebel, French & Nauman

[57] ABSTRACT

An adjustable end bracket (10) for use with a modular coated wire closet shelf (12) of the type having upper and lower front rails (14, 16) and a plurality of evenly spaced stringers (20) is disclosed. The bracket is formed of a bracket arm (32) having two parallel horizontal grooves (48) dimensioned to fit against the back side of the upper and lower front rails of the shelf, and a block (34) having two parallel horizontal grooves (46) to fit against the front side of the upper and lower front rails. The block includes a plurality of ribs (36) forming vertical slots (38) for engaging the portion of the stringer which is attached to the front rails and a pair of bolts (40) which extend outwardly from the block through holes (50) in the bracket arm so that the bracket can be clamped together by wing nuts (42) threaded on the bolts. The bracket arm is attached to an end plate (30) having a pair of prongs (28) for engaging an adjacent closet wall (26).

13 Claims, 6 Drawing Figures

ADJUSTABLE END BRACKET

BACKGROUND OF THE INVENTION

1. Field of the Invention

The present invention relates to adjustable end brackets for shelves, and more particularly to end brackets which are used with modular coated wire shelves.

2. Prior Art

In hot, moist climates it is desirable to store mildew-sensitive items, such as clothing, on shelves made of spaced wire rods coated with plastic in order to promote air circulation about and through the items and thus reduce the likelihood of mildew damage. Typically, these shelves include vertically spaced upper and lower rails, a back rail, and a plurality of stringers which extend between the back rail and the upper and lower rails and are evenly spaced along the length of the rails. The shelves are modular and are sized to fit within a standard size closet.

There are a number of means for mounting a modular coated wire shelf in a closet. For example, U.S. Pat. No. 3,598,064 discloses a modular coated wire shelf having front and rear wall mounting brackets. The front wall mounting bracket, or end bracket, is secured to a wall by a screw and a wall anchor, if necessary, and includes a U-shaped channel shaped to receive the upper and lower rails. In one embodiment, a spacer is positioned between the upper and lower rails in the U-shaped channel to prevent the weight of the load resting on the stringers from deflecting the upper rail toward the lower rail.

A disadvantage of the aforementioned end brackets is that they do not prevent slippage of the shelf with respect to the brackets while it is mounted in the closet. No closet has precisely the same inside width as a modular shelf and consequently there exists a certain amount of play between the shelf and the walls of the closet. As loads are added and removed from the shelf during use, flexing of the rails occurs which causes the ends of the rails to move relative to the end brackets thereby varying the stresses placed upon the brackets with the result that the brackets may loosen themselves from the wall.

SUMMARY OF THE INVENTION

The present invention provides an improved end bracket for modular wire coated shelves in which movement of the rails relative to the bracket is eliminated. In addition, the end bracket of the present invention is adjustable so that the shelf can accommodate closets that deviate from the standard width. By proper adjustment of the end brackets, the end brackets and upper and lower rails are combined to form a single rigid member that exerts a firm pressure against the closet walls and thereby prevents the brackets from working free from the closet walls as a result of repeated variations in shelf loads. The present invention also includes a pair of flat pronges which are pressed into a wall to support the shelf, thereby providing a flat surface which bears the shear stress of the load of the shelf better than a round screw or nail.

The end bracket of the present invention comprises a bracket arm having formed therein two longitudinal grooves adapted to receive the upper and lower rails and having formed therein at least one hole, a block having a plurality of ribs which form vertical slots adapted to receive at least the end portion of the stringers and are spaced along the length of the block at a fraction of the distance between the stringers, and having a means for interengaging the opening such that the block can be clamped against the arm, and an end plate attached to the arm having a means for engaging a wall. The shelf is mounted by first attaching the end plate to the wall at a predetermined height, positioning the shelf relative to the bracket arm so that the upper and lower rails rest against the longitudinal grooves, then clamping the block against the arm so that selected vertical slots receive the stringers. It is preferable to position the block so that it abuts the end plate to prevent movement of the block relative to the arm.

Accordingly, it is an object of this invention to provide an end bracket which is adjustable relative to a modular coated wire shelf so that it can be used to compensate for slight deviations in closet widths; to provide an end bracket which attaches to the upper and lower front rails so that movement of the rails relative to the bracket is prevented; and to provide an end bracket which rigidly attaches to the upper and lower front rails of modular coated wire shelves in which the stringers extend between the back rail and upper rail only, as well as those shelves in which the stringers extend from the back rail around the upper rail and terminate at the lower rail.

Other objects and advantages of the invention will be apparent from the following description, the accompanying drawings and the appended claims.

DETAILED DESCRIPTION OF THE PREFERRED EMBODIMENT

Figure 1:
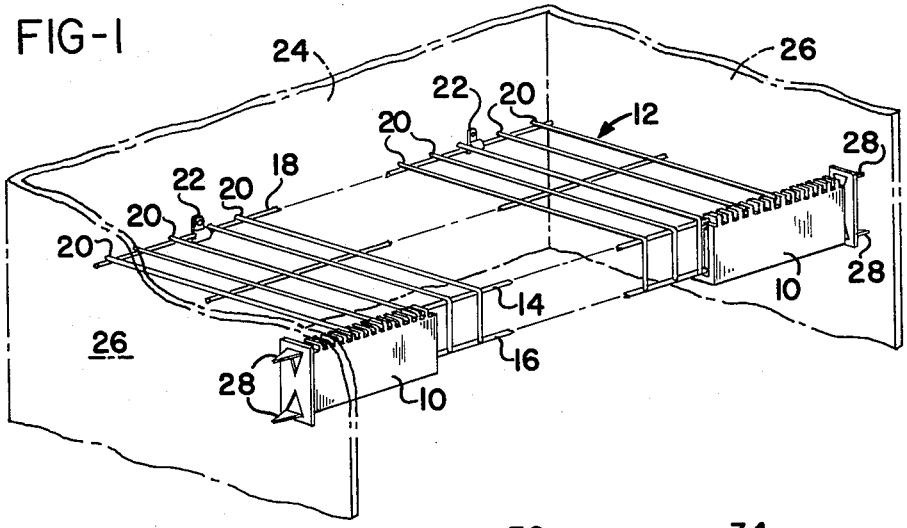
FIG. 1 is a perspective view of shelving utilizing the adjustable end bracket of the present invention.
Figure 5:
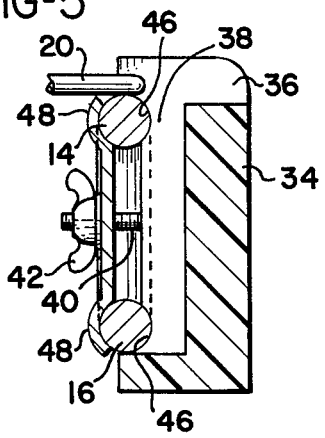
FIG. 5 is the same view as that of FIG. 4 except that a different type of shelf is shown.

As shown in FIG. 1, adjustable end brackets 10 of the present invention are used to support a modular coated wire shelf 12 having an upper front rail 14, lower front rail 16, back rail 18, and a plurality of stringers 20 extending from the back rail and the upper front rail to the lower front rail. Shelves 12 in which the stringers 20 extend from the back rail 18 only to the upper front rail 14 also can be used with the end bracket 10, as shown in FIG. 5. The back rail 18 is supported by clips 22 which are attached to the rear wall 24 of a closet or other enclosure by means of a screw and wall anchor (not shown) in a manner known in the art. The end brackets 10 each clamp an end of the upper front rail 14 and lower front rail 16 and engage a side wall 26 of the enclosure by means of prongs 28 which pierce the side wall and prevent vertical movement of the end brackets.

Figure 2:
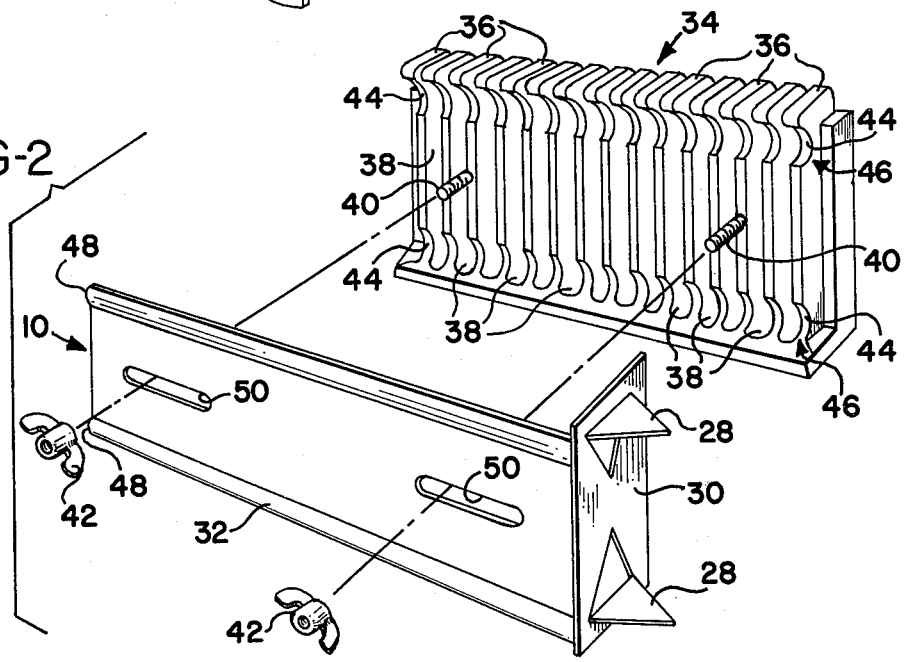
FIG. 2 is an exploded view of the present invention.

The end bracket 10 of the preferred embodiment is shown more clearly in FIG. 2. The end bracket 10 comprises an end plate 30, bracket arm 32, and block 34. The block 34 comprises a plurality of vertical raised ribs 36 which forms a series of parallel slots 38. The slots 38 are of a width sufficient to receive the stringers 20 of the shelf 12 and are evenly spaced at least the same as the stringers and preferably a fraction of the distance between stringers. The block 34 includes a clamping means to engage the brackt arm 32 which preferably consists of a pair of bolts 40, each extending from a rib 36, and a pair of wing nuts 42. Each rib 36 has two notches 44 sized and spaced apart in rows to form two grooves 46 to receive the upper and lower front rails 14, 16. The block 34 preferably is molded from a hard plastic or nylon.

The bracket arm 32 forms two longitudinal grooves 48 sized and spaced apart to receive the ends of the upper and lower front rails 14, 16. The bracket arm 32 also forms two holes 50 sized to engage the bolts 40 of the block 34. The holes 50 are oblong so that the block 34 may be adjusted relative to the arm 32. The end plate 30 and bracket arm 32 preferably are formed by stamping and bending a single piece of medium gauge sheet metal.

The prongs 28 which engage the side walls 26 are preferably triangular flaps which are punched from the end plate 30. The flat surfaces of the prongs 28 bear the shear stresses of the load on the shelf 12 better than a nail or screw because the prongs provide a wider horizontal surface.

Figure 3:
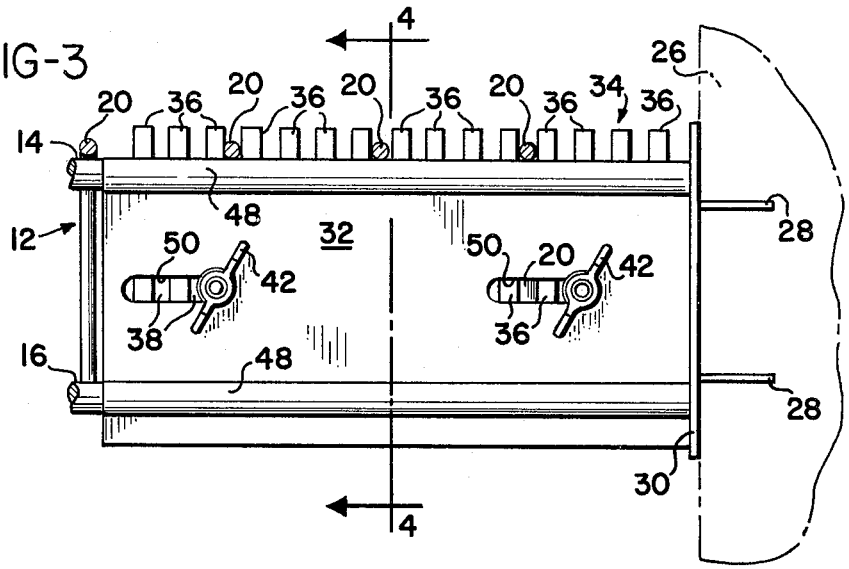
FIG. 3 is a rear elevation of the end bracket clamping a portion of the shelf.
Figure 4:
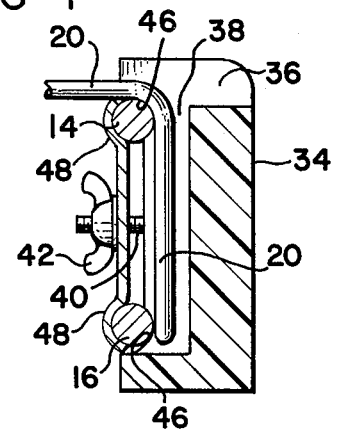
FIG. 4 is a section of the end bracket of FIG. 3 taken along the line 4—4.

The interaction of the preferred end bracket 10 and shelf 12 for installation within an enclosure is best shown in FIGS. 3, 4, and 5. The bracket arm 32 is secured to a side wall 26 at a predetermined location by pressing the prongs 28 of the end plate 30 into the wall.

The shelf 12 is first attached to the rear wall 24 by clips 22 but the screw is not firmly driven into the wall anchor so the shelf can pivot freely about the clips. The shelf 12 is then pivoted and placed against the bracket arm 32 so that the upper and lower front rails 14, 16 engage the longitudinal grooves 48 of the bracket arm. The upper and lower front rails 14, 16 are held in place against the bracket arm 32 by the block 34 which is placed against the side of the front rails opposite the side engaging the bracket arm so that the rails fit against the grooves 46 of the ribs 36 and the stringers 20 fit within the entire length of slots 38. When the block 4 is in this position, the bolts 40 pass through the holes 50 of the bracket arm 32 and the block and bracket arm are drawn together by tightening wing nuts 42 on the bolts. Thus, the stringers 20 are held within the slots 38 and the shelf 12 is prevented from moving relative to the end bracket 10. Installation is completed by tightening the screws into the wall anchors of the clips 22.

As shown in FIG. 5, this embodiment also will accommodate modular coated wire shelves 12 in which the stringers 20 extend only to the upper front rail 14. The terminal portion of the stringer 20 merely fits between the upper portions of two adjacent ribs 36.

Figure 6:
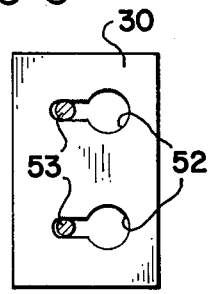
FIG. 6 is an end elevation of an embodiment of the end plates.

In FIG. 6, a different embodiment of the end plate 30 is shown. Instead of having prongs 28 punched out of the end plate 32, tear-drop shaped holes 52 are punched into the end plate. The holes 52 are sized so that their larger end will allow the head of a wood screw 53 to pass through and their smaller end is wide enough to allow the shank of the screw to pass through.

Thus, the end plate 30 is secured to the sidewall 26 by first driving two wood screws 53 into the wall while allowing some clearance between the head of the screw and the wall to remain, placing the end plate over the screws so that the screw heads pass through the larger ends of the holes 52, then sliding the end plate so that the shanks of the screws engage the smaller ends of the holes. The end plate 30 is secured to the wall by tightening the screw against the end plate.

While the forms of apparatus herein described constitute preferred embodiments of this invention, it is to be understood that the invention is not limited to these precise forms of apparatus, and that changes may be made therein without departing from the scope of the invention.

What is claimed is:

1. An end bracket for a modular coated wire shelf of the type having front rails and a back rail joined to the front rails by a plurality of stringers comprising:

a block having a plurality of vertical raised ribs defining slots therebetween of a size to receive a stringer;

a bracket arm;

means for adjustably clamping the block to the bracket arm such that the bracket arm is slidably adjustable with respect to the block and to front rails clamped therebetween and such that stringers may be held within the slots of the block; and means associated with the bracket arm for attaching the end bracket to an adjacent vertical surface positioned perpendicularly to front rails clamped between the block and the bracket arm.

2. The end bracket of claim 1 wherein the bracket arm has at least one longitudinal groove sized to receive a front rail.

3. The end bracket of claim 1 wherein the means for clamping the block to the bracket arm comprises at least one bolt extending outwardly from a rib and a wing nut threaded thereon, and the bracket arm has a hole sized to engage the bolt.

4. The end bracket of claim 1 wherein the means for attaching the end bracket to a vertical surface comprises an end plate attached to an end of the bracket arm, the end plate having at least one prong extending outwardly therefrom to pierce a vertical surface.

5. The end bracket of claim 1 wherein the raised ribs of the block each define at least one notch, the notches positioned on the ribs to form a groove sized to receive a front rail.

6. The end bracket of claim 1 wherein the adjustable clamping means comprises:

at least one bolt extending outwardly from one of the ribs;

the bracket arm defining at least one elongated opening therethrough, sized and positioned to receive the bolt such that the bracket arm may be selectively adjustable with respect to the block when the bolt extends through the hole; and a nut for engaging the bolt such that the bracket arm may be clamped between said nut and said block.

7. An end bracket for a modular coated wire shelf of the type having front rails and a back rail joined to the front rail by stringers comprising:

a block having a plurality of vertical raised ribs defining slots therebetween of a size to receive a stringer;

at least one bolt extending outwardly from a rib and a nut threaded thereon;

the raised ribs of the block each defining at least one notch, the notches positioned on the ribs to form a groove sized to receive a front rail;

a bracket arm having at least one longitudinal groove sized to receive a front rail, and which defines an elongated hole therethrough sized and positioned to engage the bolt such that the bolt is selectively positionable within the hole and the bracket arm is adjustable with respect to the block and to front rails clamped between the block and the bracket arm by the nut; and an end plate attached to an end of the bracket arm, the end plate having at least one prong extending outwardly therefrom to pierce a vertical surface.

8. In combination with a modular coated wire shelf of the type having front rails, a back rail, and a plurality of stringers joining the back rail to the front rails, an improved end bracket which comprises:

a block having a plurality of vertical raised ribs defining slots therebetween of a size to receive selected ones of the stringers, the block being positioned adjacent an end portion of the front rails;

a bracket arm positioned opposite the block and the end portion;

means for adjustably clamping the block to the bracket arm such that the bracket arm is slidably adjustable with respect to the block and to the end portion clamped therebetween and such that selected ones of the stringers adjacent the end portion are held within the slots of the block; and means for attaching the end bracket to an adjacent vertical surface positioned perpendicularly to the front rails clamped between the block and the bracket arm.

9. The combination of claim 8 wherein the bracket arm has at least one longitudinal groove sized to receive a front rail.

10. The combination of claim 8 wherein the means for clamping the block to the bracket arm comprises at least one bolt extending outwardly from a rib and a wing nut threaded thereon, and the bracket arm has a hole sized to engage the bolt.

11. The combination of claim 8 wherein the means for attaching the end bracket to a vertical surface comprises an end plate attached to an end of the bracket arm, the end plate having at least one prong extending outwardly therefrom to pierce a vertical surface.

12. The combination of claim 8 wherein the raised ribs of the block each define at least one notch, the notches positioned on the ribs to form a groove sized to receive a front rail.

13. In combination with a modular coated wire shelf of the type having front rails, a back rail, and a plurality of stringers joining the back rail to the front rails, an improved end bracket which comprises:

a block having a plurality of vertical raised ribs forming slots therebetween of a size to receive selected ones of the stringers, said block being positioned adjacent an end portion of the front rails;

at least one bolt extending outwardly from a rib and a nut threaded thereon;

the raised ribs of the block each defining at least one notch, the notches positioned on the ribs to form a groove sized to receive a front rail;

a bracket arm having at least one longitudinal groove sized to receive a front rail, and which defines an elongate hole therethrough sized and positioned to engage the bolt such that the bolt is selectively positionable within the hole and the bracket arm is adjustable with respect to the block and to front rails clamped between the block and the bracket arm by the nut; and an end plate attached to an end of the bracket arm and having at least one prong extending outwardly therefrom to pierce a vertical surface.

* * * * *